US012630984B2

(12) United States Patent
Fritz

(10) Patent No.: US 12,630,984 B2
(45) Date of Patent: May 19, 2026

(54) SELF-PROPELLED GROUND-PROCESSING MACHINE AND METHOD FOR CONTROLLING A SELF-PROPELLED GROUND-PROCESSING MACHINE, AS WELL AS METHOD FOR PROCESSING THE GROUND WITH ONE OR MORE SELF-PROPELLED GROUND-PROCESSING MACHINES

(71) Applicant: Wirtgen GmbH, Windhagen (DE)

(72) Inventor: Matthias Fritz, Hennef (DE)

(73) Assignee: Wirtgen GmbH, Windhagen (DE)

( * ) Notice: Subject to any disclaimer, the term of this patent is extended or adjusted under 35 U.S.C. 154(b) by 170 days.

(21) Appl. No.: 18/318,984

(22) Filed: May 17, 2023

(65) Prior Publication Data

US 2023/0383486 A1 Nov. 30, 2023

(30) Foreign Application Priority Data

May 25, 2022 (DE) ..... 10 2022 113 273.0

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS 6,371,566 B1 4/2002 Haehn
8,118,316 B2 2/2012 Berning et al.
(Continued)

FOREIGN PATENT DOCUMENTS

CN 108930218 A 12/2018
DE 19617442 C1 1/1998
(Continued)

OTHER PUBLICATIONS

European Search Report for corresponding patent application No. 23172720.7, dated Nov. 3, 2023, 16 pages (not prior art).
(Continued)

*Primary Examiner* — Donald J Wallace
*Assistant Examiner* — Shivam Sharma
(74) *Attorney, Agent, or Firm* — Gary L. Montle; Lucian Wayne Beavers; Patterson Intellectual Property Law, PC

(57) ABSTRACT

The invention relates to a self-propelled ground-processing machine—in particular, road-milling machine—which has a machine frame 3 supported by running gears; and a ground-processing device—in particular, milling drum 10—arranged on the machine frame 3; and lifting devices 4A, 5A, 6A, 7A assigned to the running gears 4, 5, 6, 7. The ground-processing machine is characterized by a transverse inclination model determination device 17 which provides, in a preceding working process, the information, required for performing a working process following the preceding working process, with respect to the transverse inclination α to be set of the machine frame 3 or the milling drum 10, so that the subsequent processing process can be performed even if a suitable reference surface for determining distance values for a milling-depth control is not present on one side of the processed route portion. Furthermore, the invention relates to a method for controlling a ground-processing
(Continued)

machine and to a method for processing the ground with one or more self-propelled ground-processing machines.

18 Claims, 12 Drawing Sheets

(56) References Cited

U.S. PATENT DOCUMENTS

| | | | | |
|---|---|---|---|---|
| 8,690,474 | B2 | 4/2014 | Jurasz et al. | |
| 9,926,674 | B2 | 3/2018 | Orefice | |
| 2017/0037586 | A1* | 2/2017 | Kröll | E02F 9/024 |
| 2018/0340302 | A1* | 11/2018 | Menzenbach | E01C 23/088 |
| 2020/0131722 | A1 | 4/2020 | Winkels | |
| 2021/0079600 | A1* | 3/2021 | Berning | E01C 19/05 |
| 2022/0051193 | A1 | 2/2022 | Paulsen et al. | |
| 2022/0145552 | A1 | 5/2022 | Menzenbach et al. | |
| 2022/0290383 | A1 | 9/2022 | Buschmann et al. | |
| 2023/0086241 | A1 | 3/2023 | Fritz | |
| 2023/0304235 | A1 | 9/2023 | Berning et al. | |

FOREIGN PATENT DOCUMENTS

| | | | |
|---|---|---|---|
| DE | 19756676 | C1 | 6/1999 |
| DE | 102006020293 | A1 | 11/2007 |
| DE | 102014018082 | A1 | 6/2016 |
| DE | 102017005015 | A1 | 11/2018 |
| DE | 102018127222 | A1 | 4/2020 |
| DE | 102019135225 | A1 | 6/2021 |
| EP | 1855899 | A1 | 11/2007 |
| EP | 3040477 | A2 | 7/2016 |
| EP | 4249680 | A1 | 9/2023 |
| WO | 9742377 | A1 | 11/1997 |
| WO | 2006094795 | A1 | 9/2006 |

OTHER PUBLICATIONS

China Office Action for corresponding patent application No. 2025082100299030, dated Aug. 21, 2025, 12 1 pages (not prior art).

* cited by examiner

SELF-PROPELLED GROUND-PROCESSING MACHINE AND METHOD FOR CONTROLLING A SELF-PROPELLED GROUND-PROCESSING MACHINE, AS WELL AS METHOD FOR PROCESSING THE GROUND WITH ONE OR MORE SELF-PROPELLED GROUND-PROCESSING MACHINES

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims the benefit of German Patent Application No. DE 10 2022 113 273.0, filed May 25, 2022, and which is hereby incorporated by reference.

FIELD OF THE INVENTION

The invention relates to a self-propelled ground-processing machine, and in particular a road-milling machine, which has a machine frame supported by running gears, a ground-processing device, in particular a milling drum, arranged on the machine frame, and lifting devices assigned to the running gears. Furthermore, the invention relates to a method for controlling a self-propelled ground-processing machine, in particular a road-milling machine. Furthermore, the invention relates to a method for processing a ground with a self-propelled ground-processing machine, in particular a road-milling machine, wherein adjacent tracks are processed with the ground-processing machine in successive working operations, and to a method for simultaneously processing a first track with a first and a second track with a second self-propelled ground-processing machine, in particular a road-milling machine. The invention also relates to a machine combination of several ground-processing machines for simultaneously processing the ground.

BACKGROUND

The term "ground-processing machine" as used herein may be understood to mean a construction machine that is suitable for removing material from the ground. The ground to be processed can, for example, be an existing traffic area (road) from which material is to be milled.

In road construction, self-propelled ground-processing machines of different designs are used. These ground-processing machines include known road-milling machines with which existing road layers of the road superstructure can be removed. Known road-milling machines have a rotating milling drum which is equipped with milling tools for processing the road. The milling drum is arranged on the machine frame, which is adjustable in height relative to the road to be machined. The height adjustment of the machine frame takes place by means of lifting devices, which are assigned to the individual running gears (crawler tracks or wheels). In order to mill a damaged road surface, the machine frame is lowered so that the milling drum penetrates the road surface. The lifting devices allow not only the height adjustment of the machine frame or of the milling drum, but also the setting of a predetermined inclination of the machine frame or of the milling drum relative to the horizontal or the surface of the road.

For precisely setting the milling depth and the transverse inclination in a direction transverse to the working direction of the road-milling machine, the known road-milling machines have milling-depth control devices or leveling systems, which have one or more measuring devices for measuring the distance between a reference point on the road-milling machine and the road surface to be processed, or another face or line, e.g., a plane spanned by a laser, or a tensioned wire. Milling-depth control devices or leveling systems generally also have a measuring device for measuring the transverse inclination of the machine frame.

A leveling device for a road-milling machine is known from DE 10 2006 020 293 A1, which leveling device provides, both on the left and the right side of the road-milling machine, a distance measuring device for detecting the actual value of the milling depth. The milling depth on the left and the right side of the machine can be controlled as a function of the deviation of the measured actual values from the target values.

The roads to be processed can have different profiles, wherein the transverse inclination can change. In a right-hand curve, the road surface is inclined to the right in the direction of travel relative to the horizontal, and, in a left-hand curve, it is inclined to the left. A road can be inclined to the one side or the other side on a straight route portion. Consequently, the transverse inclination of a road can change over the course of the route.

At the beginning of the milling work, the ground-processing machine is positioned on the lane. The lifting devices assigned to the running gear units are then retracted so that the machine frame is lowered with the milling drum. The machine frame is lowered until the milling tools of the rotating milling drum just touch the road surface. This process is referred to as "scratching." In this case, the milling drum or the milling drum axis should be oriented in a predetermined transverse inclination relative to the horizontal—in particular, parallel to the road surface to be processed—as a result of which the orientation of the machine frame on which the milling drum is arranged is determined. This transverse inclination can also be zero.

If a portion of a road on the inside of the lane is to be processed, the milling depth can be measured on both sides of the road-milling machine. For this purpose, the distance of a reference point related to the machine frame of the road-milling machine and located on the left side of the milling drum in the working direction from the unprocessed ground on the left side, and the distance of a reference point related to the machine frame of the road-milling machine and located on the right side of the milling drum from the unprocessed ground on the right side are measured. If a route portion on the outside of the lane is to be milled, the milling depth can be measured on the left side of the milling drum. However, a suitable reference surface is not present on the right side of the construction machine. For this reason, a distance measurement at the right lane edge cannot be carried out easily. For a distance measurement on the right side of the construction machine, a guide wire could be laid, but this proves to be relatively complicated in practice.

In the present case, the milling depth on the right side of the ground-processing machine could also be controlled via the transverse inclination of the machine frame or of the milling drum relative to the horizontal, which transverse inclination can be detected by means of an inclination sensor during the advance of the machine. An inclination of the ground-processing machine to the left results in a decrease of the milling depth on the right side of the ground-processing machine, and an inclination of the milling machine to the right results in an increase in the milling depth on the right side of the ground-processing machine. However, in order to be able to set the milling depth on the right side by changing the transverse inclination of the machine frame, the inclination (target value) to be set would have to be known over the entire course of the route. For this reason, additional information (data) about the inclination profile along the route portion to be processed would have to be provided before the start of the milling work. In practice, this requires walking the route portion that is to be machined, measuring the transverse inclination, and applying appropriate markers to the lane.

DE 10 2014 018 082 A1 describes an automated method for controlling a milling machine, in which markings attached to the lane are detected with a camera in order to generate control commands assigned to the markings.

BRIEF SUMMARY

The present disclosure describes a ground-processing machine which enables an exact processing of the ground, and in particular, allows an exact processing of the ground without the provision of additional information about the transverse inclination of the ground surface before the milling work, even if no suitable reference surface for determining distance values is present on one side of the route portion to be processed. One object of the present disclosure is further to specify a corresponding method for controlling a ground-processing machine and a method for processing the ground with a ground-processing machine in successive working processes or the simultaneous processing of the ground with two or more than two ground-processing machines which, even in the absence of a suitable reference surface on one side of the ground-processing machine, allows exact processing of the ground, and in particular without the provision of additional information about the transverse inclination of the ground surface before the milling work. In this case, an exact processing of the ground should also be possible if the transverse inclination of the route portion to be processed changes over the course of that route, for example, in a curve or during the transition from a straight route portion to a curve, or vice versa.

One or more embodiments of an invention as described herein can comprise one or more of the features or feature combinations mentioned below. A feature denoted by an indefinite article can also be present multiple times if the indefinite article is not to be understood with an explicit indication of only one-time use. A denotation of features by a numeral, e.g., "first and second," does not preclude that these features can be present more times than the number indicated by the numeral. In the description of all embodiments, the expression, "can," is also to be understood as "preferably" or "expediently."

A self-propelled ground-processing machine, in particular a road-milling machine, as disclosed herein has a machine frame, supported by running gears, and a ground-processing device—in particular, a milling drum—arranged on the machine frame. Assigned to the running gears are lifting devices, which can be retracted or extended in order to lower or raise the running gears relative to the machine frame. Furthermore, the ground-processing machine has a control device which is configured in such a way that control signals for the lifting devices are generated. The control device can at least partially be part of a central control and computing unit of the ground-processing machine or form an independent assembly, wherein the control device can also consist of several units. The lifting devices are designed in such a way that the running gears are retracted or extended as a function of the control signals.

The self-propelled ground-processing machine as disclosed herein comprises a transverse inclination model determination device which provides, in a preceding working process, the information, required for performing a working process following the preceding working process, with respect to the transverse inclination to be set of the machine frame or of the longitudinal axis of the ground-processing device—in particular, milling drum—so that the subsequent processing process can be performed even if a suitable reference surface for determining distance values is not present on one side of the route portion to be processed.

The transverse inclination model determination device as disclosed herein has a transverse inclination sensor which is designed in such a way that, during the advance of the ground-processing machine, in a preceding working process—in particular, during the milling of a route portion on the inside of the lane—a sequence of transverse inclination values describing the transverse inclination of the processed ground in a direction transverse to the working direction are determined—in particular, for the milling of a route portion on the outside of the lane. Furthermore, the transverse inclination model determination device has an evaluation device which is designed in such a way that a transverse inclination model describing the transverse inclination is created from the sequence of the transverse inclination values. Furthermore, the transverse inclination model determination device comprises a memory device for storing a transverse inclination model determined in a preceding working process.

The control device is configured in such a way that it provides a transverse inclination recording mode for a preceding track, in which transverse inclination values are determined with the transverse inclination sensor in the preceding track during the advance of the ground-processing machine, and a transverse inclination model for a track following the preceding track is created with the evaluation device from the transverse inclination values, and the transverse inclination model is stored in the memory device.

Furthermore, the control device is configured in such a way that it provides a transverse inclination control mode for a track following the preceding track, in which, during the advance of the ground-processing machine in the subsequent track, the control of at least one of the lifting devices takes place as a function of the transverse inclination values that are determined on the basis of the transverse inclination model read from the memory device. As a result, ground-processing is simplified and accelerated.

Generally speaking, it is irrelevant how the transverse inclination model is designed. However, the transverse inclination model may preferably be designed such that all information (data) which is required for controlling the transverse inclination is provided with the model. Models suitable for this purpose are known to those of skill in the art. A particularly suitable model is the known TIN model (triangulated irregular network model), which models the transverse inclination of the desired terrain surface by a triangular mesh. By interpolation, the TIN model allows the determination of the transverse inclination at all points which lie in or on the triangles that form the TIN model. The methods or algorithms required for this purpose are known to those of skill in the art.

The embodiment described above of the ground-processing machine allows the processing of adjacent lanes in successive work steps with the same machine. However, the simultaneous processing of adjacent lanes with two ground-processing machines or more than two ground-processing machines is also possible if one ground-processing machine runs ahead of another ground-processing machine in the longitudinal direction of the course of the route, i.e., the ground-processing machines do not run next to one another at the same level, which is not possible anyway in the case of a seamless transition between the individual lanes, which is intended.

One of the two ground-processing machines for performing the ground-processing in combination with another ground-processing machine has a transverse inclination model transmission device, which has a data transmission device, wherein the data transmission device is designed in such a way that the transverse inclination model is sent to a data receiving device of another ground-processing machine traveling in another track or to a cloud. The control device is configured in such a way that the control device provides a transverse inclination recording mode in which, during the advance of the ground-processing machine in one track, transverse inclination values are determined with the transverse inclination sensor, and a transverse inclination model is created from the transverse inclination values with the evaluation device, and the transverse inclination model is sent to a data receiving device of another ground-processing machine traveling in another track or to a cloud, so that the transverse inclination of the machine frame or of the ground-processing device—in particular, milling drum—of the other ground-processing machine can be set automatically with the information (data) provided by the transverse inclination model.

The other ground-processing machine has a transverse inclination model transmission device, which has a data receiving device which is designed in such a way that a transverse inclination model is received from the data transmission device of the one ground-processing machine or from a cloud, wherein the control device is configured in such a way that the control device provides a transverse inclination control mode in which, during the advance of the ground-processing machine in the track other than the track in which the transverse inclination has been determined, the control of at least one of the lifting devices takes place at least as a function of the transverse inclination values that are determined on the basis of the transverse inclination model.

However, it is also possible for both ground-processing machines to have a data transmission device and a data receiving device so that both machines can assume both tasks. Both machines can also have a memory device for storing the transverse inclination model so that processing of the ground is possible in successive working processes with either machine without the respective other machine.

The control device of the self-propelled ground-processing machine preferably has both a first measuring device for measuring the distance of a reference point on the ground-processing machine from the surface of the non-processed ground on one side of the ground-processing device in the working direction of the ground-processing machine, and a second measuring device for measuring the distance of a reference point on the ground-processing machine from the surface of the non-processed ground on the other side of the ground-processing device in the working direction of the ground-processing machine. The term, "the other side," is understood to mean the side opposite the one side. The one side can be the left side in the working direction, and the other side can be the right side in the working direction, or vice versa. However, both measuring devices are required only for the preceding working process. For leveling in the subsequent working process, a measuring device is required on only one of the two sides, since a transverse inclination control takes place in the subsequent working process.

For the creation of the transverse inclination model, the control device can be configured in such a way that the lifting devices are controlled in the transverse inclination recording mode in such a way that, during the advance of the ground-processing machine, the milling depth, detected by the first measuring device, on the one side of the ground-processing device and the milling depth, detected by the second measuring device, on the other side of the ground-processing device are kept substantially constant (copy milling), irrespective of the nature of the ground surface. The milling depth specified in a preceding working process on both sides of the ground-processing machine defines the transverse inclination, on the basis of which a subsequent working process can be performed.

In the transverse inclination control mode, the control device can be configured in such a way that at least one of the lifting devices is controlled in such a way that, during the advance of the ground-processing machine, the milling depth, detected by one of the two measuring devices, if two measuring devices are present, is kept substantially constant on one of the two sides of the ground-processing device, irrespective of the nature of the ground surface. At least one of the lifting devices can then, at least as a function of the transverse inclination values that are determined on the basis of the transverse inclination model, be controlled in such a way that, during the advance of the ground-processing machine, the machine frame assumes a transverse inclination which corresponds to the transverse inclination predetermined by the transverse inclination model.

The ground-processing machine can have a position determination device, wherein the control device is designed in such a way that, for generating the transverse inclination model, position-related transverse inclination values are determined from the transverse inclination values, wherein the position-related transverse inclination values can relate to a coordinate system independent of the ground-processing machine. If the transverse inclination values are recorded at particular waypoints, these waypoints (position points) can be determined by the coordinates in a coordinate system independent of the ground-processing machine. The position-related transverse inclination values can comprise the x-coordinates and y-coordinates, determined in an independent coordinate system by the position determination device, of those position points where the transverse inclination is measured with the transverse inclination sensor, and the transverse inclinations measured at these position points. The position determination device for determining position-related transverse inclination values can, for example, be a global navigation satellite system (GNSS).

The first and/or second measuring device can have at least one distance sensor, which is a contact distance sensor or a non-contact distance sensor. Such distance measuring systems belong to the prior art. For example, optical or inductive or capacitive distance sensors or ultrasonic distance sensors can be used as contactless distance sensors. For example, the edge protection of a road milling machine, which is generally provided next to the milling drum, can also function as a contact sensor of the distance measuring device. For example, a draw-wire sensor can detect the position, relative to the machine frame, of the left and/or right edge protector in the working direction, which protector rests in a floating manner on the ground surface to be processed. If the milling depth is increased, the edge protector moves upwards relative to the machine frame by an amount that corresponds to the change in the milling depth. On the other hand, if the milling depth is reduced, the edge protector moves downwards relative to the machine frame by an amount that corresponds to the change in the milling depth.

A method as disclosed herein for controlling a self-propelled ground-processing machine—in particular, road-milling machine—and methods for processing the ground are characterized by a transverse inclination recording mode, in which, during the advance of the ground-processing machine in one track, a sequence of transverse inclination values describing the transverse inclination of the processed ground in a direction transverse to the working direction are determined, a transverse inclination model describing the transverse inclination is created from the sequence of the transverse inclination values, and the transverse inclination model is stored. Furthermore, methods as disclosed herein are characterized by a transverse inclination control mode, in which, during the advance of the ground-processing machine in a track other than the track in which the transverse inclination values have been determined, the control of at least one of the lifting devices takes place at least as a function of the transverse inclination values that are determined on the basis of the stored transverse inclination model.

Furthermore, the present disclosure relates to a method for processing a ground with a self-propelled ground-processing machine—in particular, road-milling machine—which has a machine frame supported by running gears; and a ground-processing device—in particular, milling drum—arranged on the machine frame; and lifting devices, assigned to the running gears, for raising and lowering the running gears relative to the machine frame. In the method as disclosed herein, adjacent tracks are processed with the ground-processing machine in successive working operations, wherein during the processing of a preceding track, during the advance of the ground-processing machine, a sequence of transverse inclination values describing the transverse inclination of the processed ground in a direction transverse to the working direction is determined, a transverse inclination model describing the transverse inclination for the processing of a subsequent track is created from the sequence of the transverse inclination values, and the transverse inclination model is stored, and, during the processing of a track following the preceding track, during the advance of the ground-processing machine, the control of at least one of the lifting devices takes place at least as a function of the transverse inclination values that are determined on the basis of the stored transverse inclination model. Consequently, the method as disclosed herein comprises a transverse inclination recording mode and a transverse inclination control mode.

In the transverse inclination recording mode, the lifting devices can be controlled in such a way that, during the advance of the ground-processing machine, the milling depth, detected by a first measuring device, which is arranged on the one side of the ground-processing device in the working direction, and the milling depth, detected by a second measuring device, which is arranged on the other side of the ground-processing device in the working direction, i.e., the side opposite the one side, are kept substantially constant, irrespective of the nature of the ground surface.

In order to create the transverse inclination model, position-related transverse inclination values can be determined from the transverse inclination values determined in the transverse inclination recording mode, said position-related transverse inclination values comprising x-coordinates and y-coordinates, describing the position of position points, and the transverse inclinations determined at these position points. For the creation of the transverse inclination model, it is sufficient if the transverse inclination is detected only at a few points characteristic of the transverse inclination profile.

In addition, a method is disclosed herein for simultaneously processing a ground with a first and a second self-propelled ground-processing machine—in particular, road-milling machine—which each have a machine frame supported by running gears; and a ground-processing device—in particular, milling drum—arranged on the machine frame; lifting devices, assigned to the running gears, for raising and lowering the running gears relative to the machine frame; and a control device for actuating the lifting devices, wherein a first track and a second track, which are adjacent, are simultaneously processed with the first ground-processing machine and with the second ground-processing machine, respectively. The method is not limited to the processing of the ground with only two ground-processing machines. The ground can also be processed with more than two ground-processing machines. What is decisive is that, in a working process with one machine, the information, required for performing a working process with another machine or other machines, with respect to the transverse inclination $\alpha$ of the machine frame or of the milling drum is provided.

In a transverse inclination recording mode, during the processing of a first track, during the advance of a first ground-processing machine, a sequence of transverse inclination values describing the transverse inclination of the processed ground in a direction transverse to the working direction can be determined, and a transverse inclination model describing the transverse inclination can be created from the sequence of the transverse inclination values, and the transverse inclination model can be transmitted to a second ground-processing machine. In a transverse inclination control mode, during the processing of a second track with the second ground-processing machine, the control of at least one of the lifting devices can take place at least as a function of the transverse inclination values that are determined on the basis of the transverse inclination model received from the first ground-processing machine. The information (data) can be transmitted via a cloud.

BRIEF DESCRIPTION OF THE SEVERAL VIEWS OF THE DRAWINGS

Exemplary embodiments of the ground-processing machine as disclosed herein are described in detail below with reference to the drawings.

DETAILED DESCRIPTION

Figure 1:
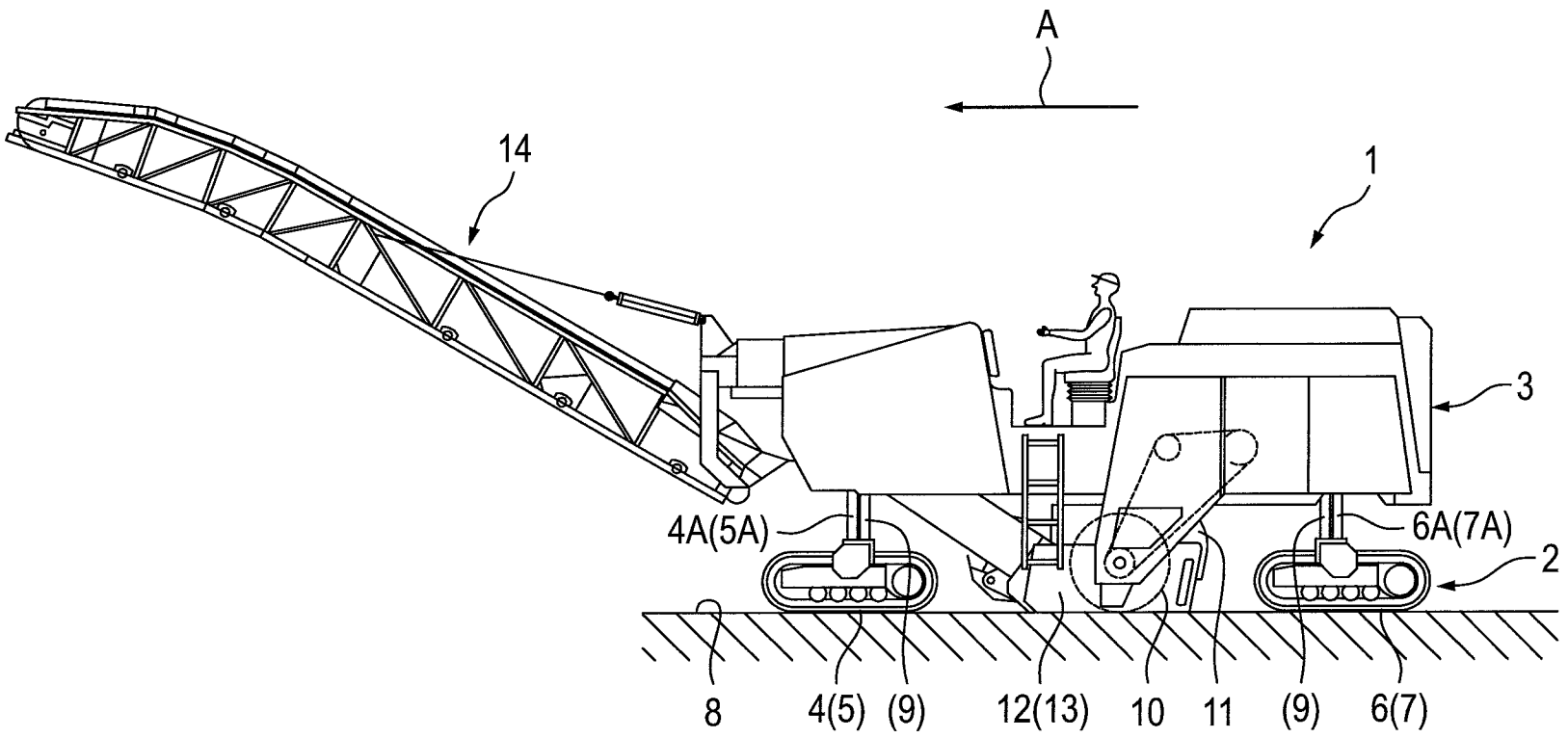
FIG. 1 shows a side view of an exemplary embodiment of the ground-processing machine according to the invention.
Figure 2:
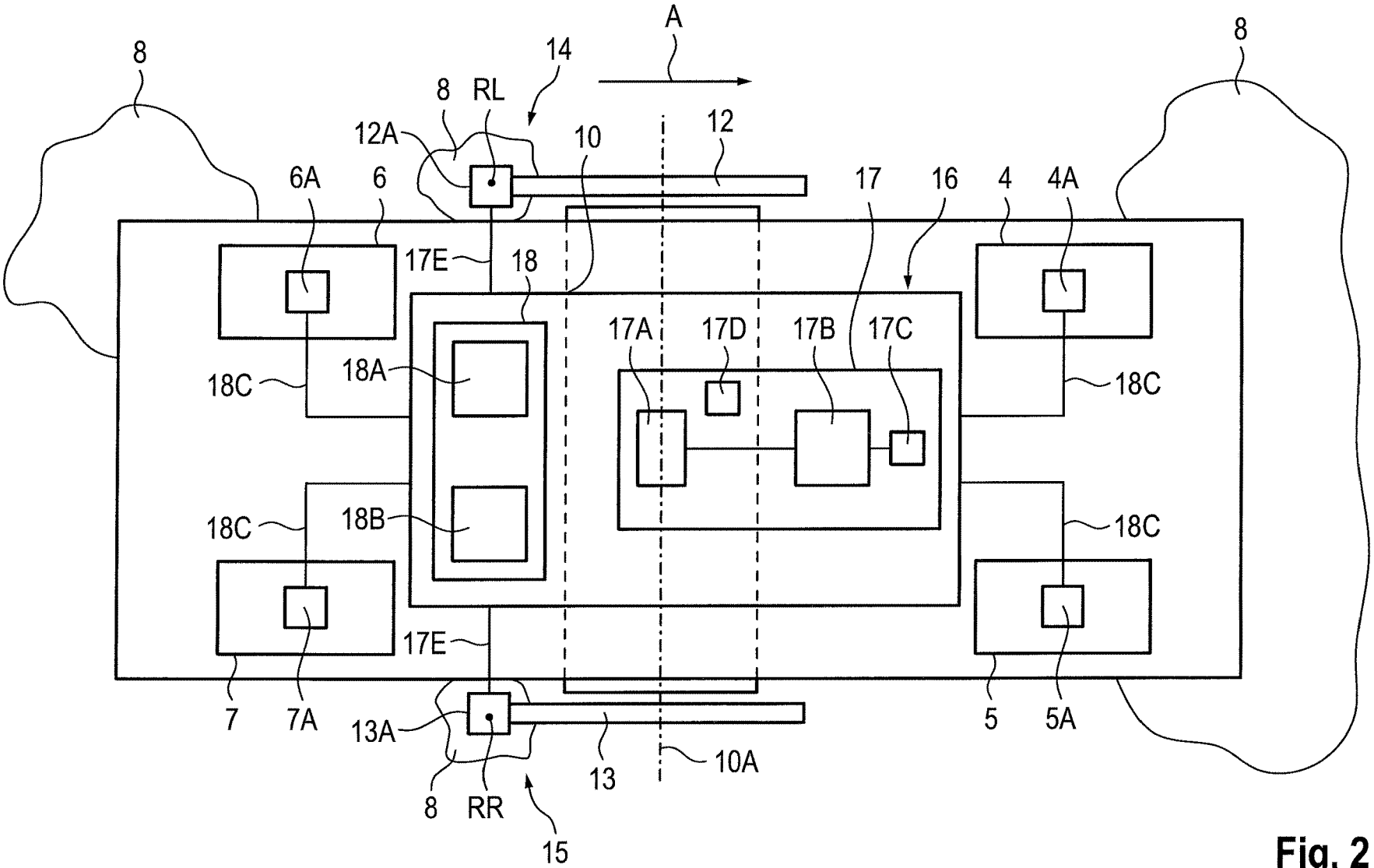
FIG. 2 shows a simplified schematic representation of the individual components of the ground-processing machine.

FIG. 1 is a side view of an exemplary embodiment of a self-propelled ground-processing machine 1. In the present exemplary embodiment, the ground-processing machine is a road-milling machine, and the ground to be processed is a road. Below, the one side of the ground-processing machine in the working direction is referred to as the left side and the other side of the ground-processing machine in the working direction is referred to as the right side of the ground-processing machine, wherein the ground-processing machine is intended for the processing of a road for right-hand traffic. FIG. 2 shows the individual components of the ground-processing machine 1 in a simplified schematic representation, wherein the components corresponding to one another are provided with the same reference signs.

The ground-processing machine 1 has an undercarriage 2 and a machine frame 3. The undercarriage 2 has a front left running gear 4 and a front right running gear 5 in the working direction A, as well as a rear left running gear 6 and a rear right running gear 7 in the working direction A. Track units or wheels can be provided as running gear units.

In order to adjust the height and/or inclination of the machine frame 3 relative to the surface 8 of the ground (road surface), the ground-processing machine 1 has lifting devices 4A, 5A, 6A, 7A which are assigned to the individual running gears 4, 5, 6, 7 and support the machine frame 3. The lifting devices 4A, 5A, 6A, 7A each have a piston/cylinder arrangement 9 for adjusting the running gear units.

The rear running gears 4, 5 of the ground-processing machine 1 are hydraulically force-coupled to one another in such a way that raising the left rear running gear 4 causes the right rear running gear 5 to be lowered, and lowering the left rear running gear 4 causes the right rear running gear 5 to be raised. However, the running gears can also be coupled mechanically. Instead of the rear axle, the front axle can also be force-coupled—for example, as in the case of a few compact or small milling machines. A hydraulic coupling of the running gears of a front axle is described, for example, in DE 196 17 442 C1. However, all four running gears can also be force-coupled (EP 1 855 899 A1). Instead of a front or rear force-coupled axle, the respective axle can also be formed only by a single center running gear. For the invention, it is ultimately irrelevant how the undercarriage is designed.

The ground-processing machine 1 moreover has a milling drum 10 which is equipped with milling tools and is arranged on the machine frame 3 between the front and rear running gears 4, 5, 6, 7 in a milling drum housing 11, which is closed on the longitudinal sides by a left and right edge protector 12, 13.

By retracting and extending the piston/cylinder arrangements 9 of the lifting devices 4A, 5A, 6A, 7A, the height and/or inclination of the machine frame 3 and of the milling drum 10 arranged on the machine frame can be set relative to the substrate surface 8. For the removal of the milled road surface, a conveyor device 14 having a conveyor belt is provided.

The ground-processing machine 1 has a first distance measuring device 14 which is left in the working direction and is designed in such a way that the distance between a first, left reference point RL, related to the machine frame 3, and the ground surface 8 is measured, and a second distance measuring device 15 which is right in the working direction and is designed in such a way that the distance between a second, right reference point RR, related to the machine frame 3, and the ground surface 8 is measured.

Figure 4:
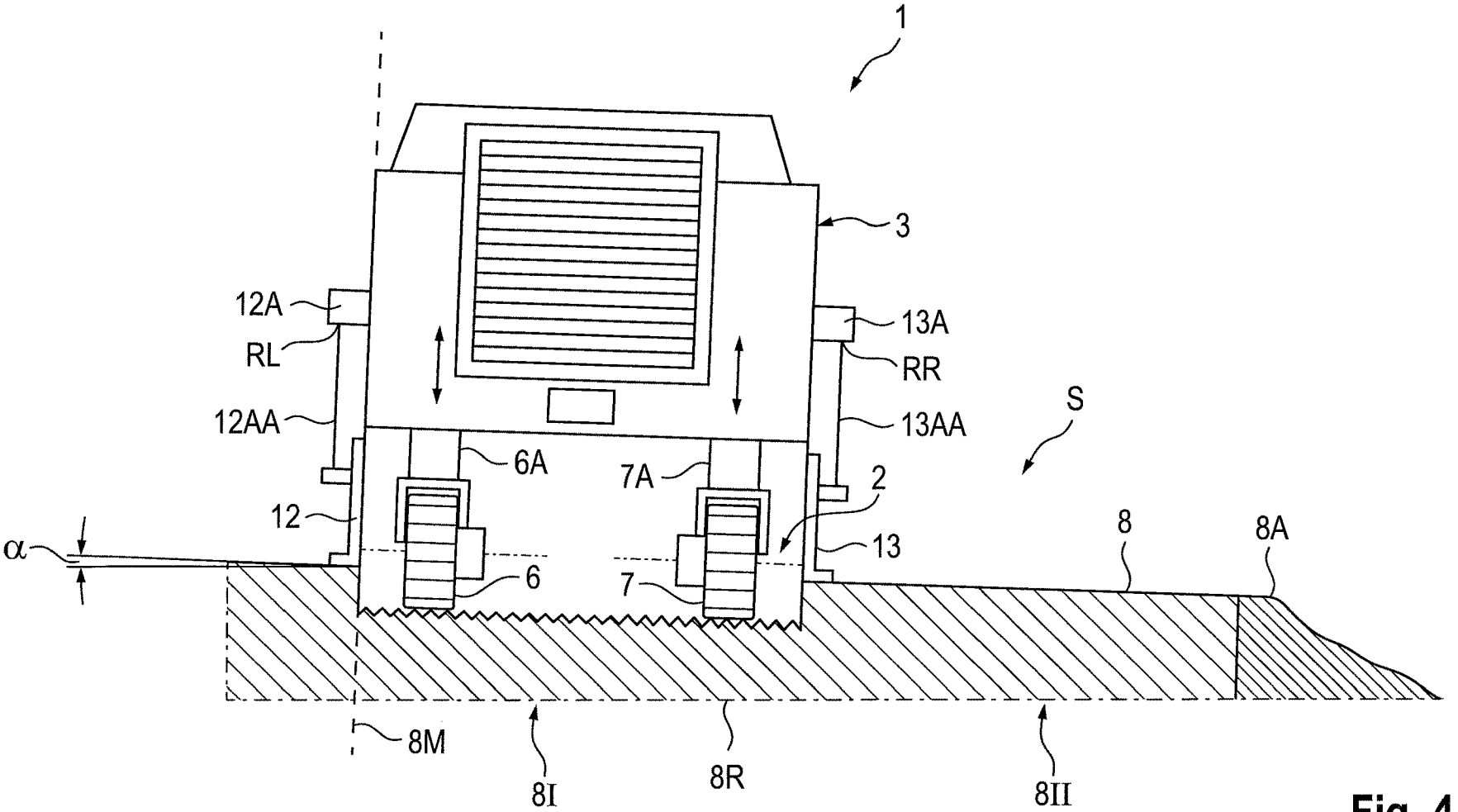
FIG. 4 shows a rear view of the ground-processing machine of FIG. 3.

In the present exemplary embodiment, the two distance measuring devices 14, 15 are contact measuring devices which make use of the left or right edge protector 12, 13, which is arranged laterally next to the milling drum 10 on the left or right side of the machine frame 3 in the working direction between the front and rear running gears 4, 5, 6, 7. The first or second measuring device 14, 15 has a left or right draw-wire sensor 12A, 13A, wherein the loose end of the draw-wire 12AA, 13AA is fastened to the left or right edge protector 12, 13 (FIG. 4). The left or right edge protector 12, 13 rests on the ground surface 8. The draw-wire sensor 12A, 13B measures the distance by which the edge protector 12, 13 moves up and down. Consequently, the distance between the reference point RL or RR and the ground surface 8 on which the edge protector 12 or 13 rests can be measured. If the edge protector is fastened so as to be height-adjustable via two hydraulic cylinders arranged at an offset in the direction of travel, the height of the edge protector can also be detected by means of a displacement sensor system integrated into the hydraulic cylinders.

Furthermore, the ground-processing machine 1 has a control device 16 which can form an independent assembly or can be at least partially a part of the central control and computing unit (not shown) of the construction machine. The control device 16 can have, for example, a general processor, a digital signal processor (DSP) for continuously processing digital signals, a microprocessor, an application-specific integrated circuit (ASIC), an integrated circuit (FPGA) consisting of logic elements, or other integrated circuits (IC) or hardware components, in order to carry out the actuation of the lifting devices and the capture and evaluation of the measured values. A data processing program (software) can run on the hardware components. A combination of the various components is also possible. The control device 16 is configured in such a way that the individual steps of the method according to the invention for controlling the ground-processing machine are carried out.

The control device 16 is connected via signal lines 17E or data lines to the draw-wire sensors 12A, 13A of the distance measuring devices 14, 15 and generates control signals for the lifting devices 4A, 5A, 6A, 7A. The lifting devices 4A, 5A, 6A, 7A are designed in such a way that their piston/ cylinder arrangements 9 are retracted or extended as a function of the control signals, so that the running gears 4, 5, 6, 7 are raised or lowered relative to the machine frame 3. The control signals are transmitted via control or data lines 18C.

An exemplary embodiment of a ground-processing machine as disclosed herein and a method for the control thereof are described below with reference to the schematic representation of the ground-processing machine in FIG. 2 and FIGS. 3 through 7.

Figure 5:
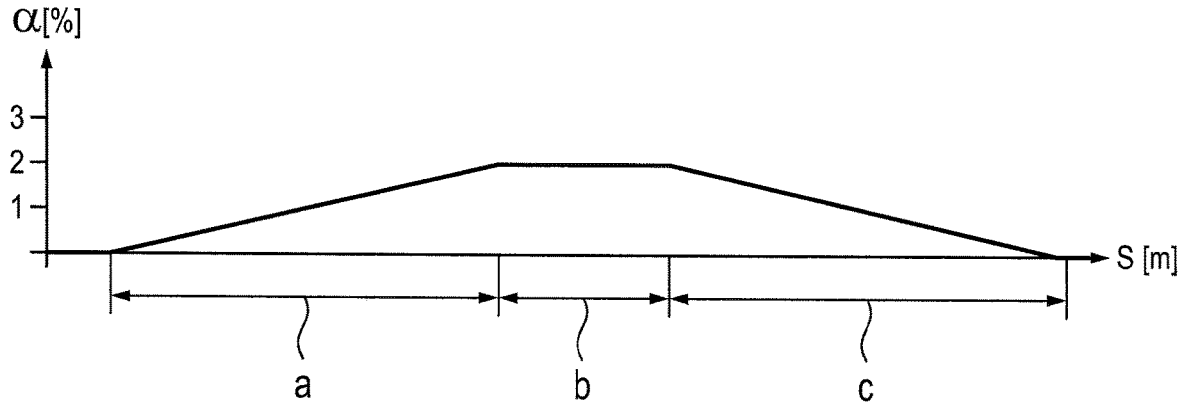
FIG. 5 shows the transverse inclination profile in a curve.

The traffic areas to be processed can have different profiles, wherein the transverse inclination α can change. In a right-hand curve, the road surface can be inclined to the right in the direction of travel relative to the horizontal, and, in a left-hand curve, it can be inclined to the left. A road can be inclined to the one side or the other side on a straight route portion. Consequently, the transverse inclination of a road can change over the course of the route. FIG. 5 shows the transverse inclination profile in a right curve. The transverse inclination of the road increases towards the center of the curve (route portion a), remains the same in the center of the curve (route portion b), and decreases again after the center of the curve (route portion c).

In the present exemplary embodiment, the ground-processing machine 1 is intended to mill a road surface from the right lane of a road. The control device 16 of the ground-processing machine 1 is configured in such a way that the steps described below are carried out.

Figure 3:
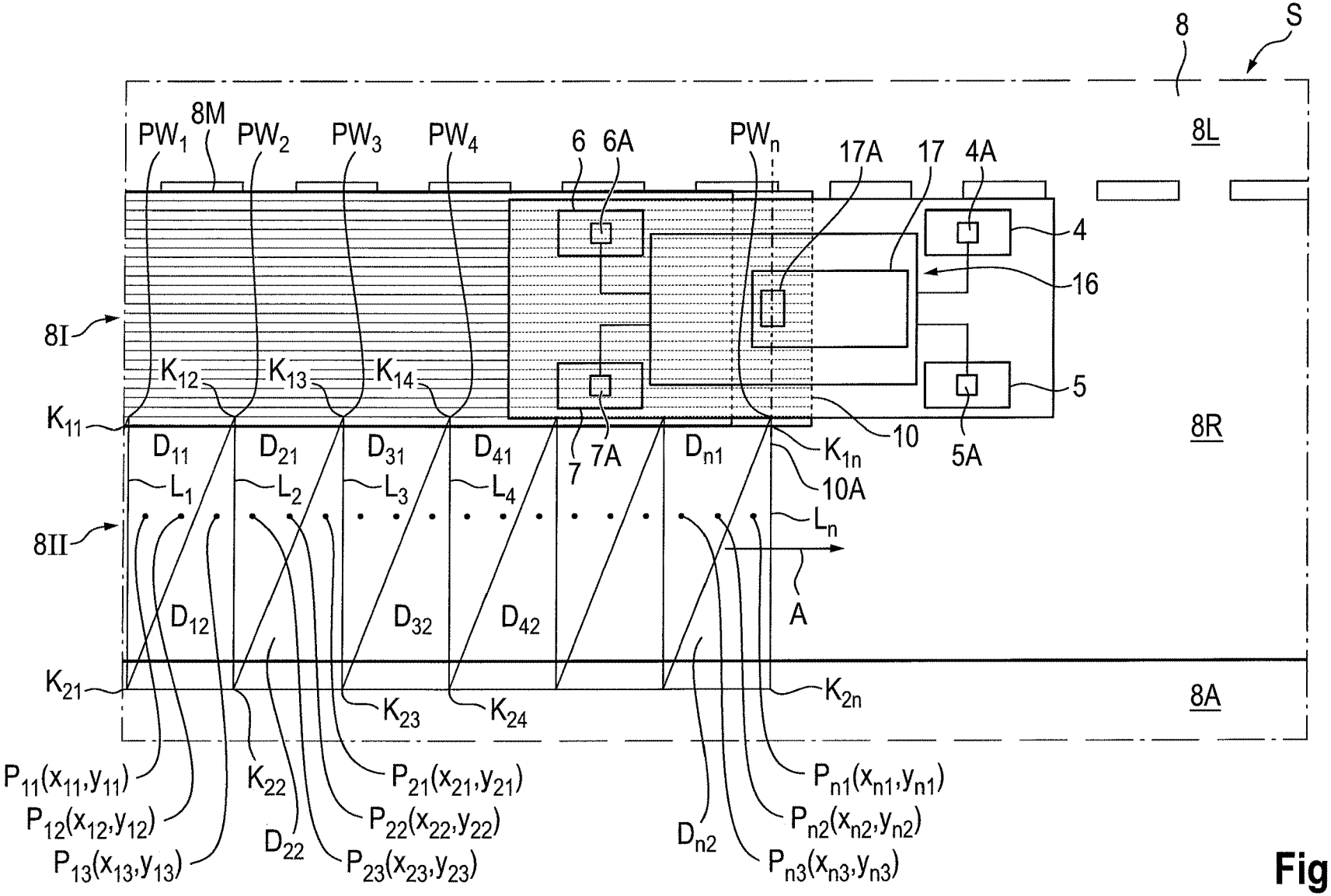
FIG. 3 shows a plan view of a road which is being processed by the ground-processing machine, wherein the ground-processing machine is processing a route portion on the inside of the lane.
Figure 6:
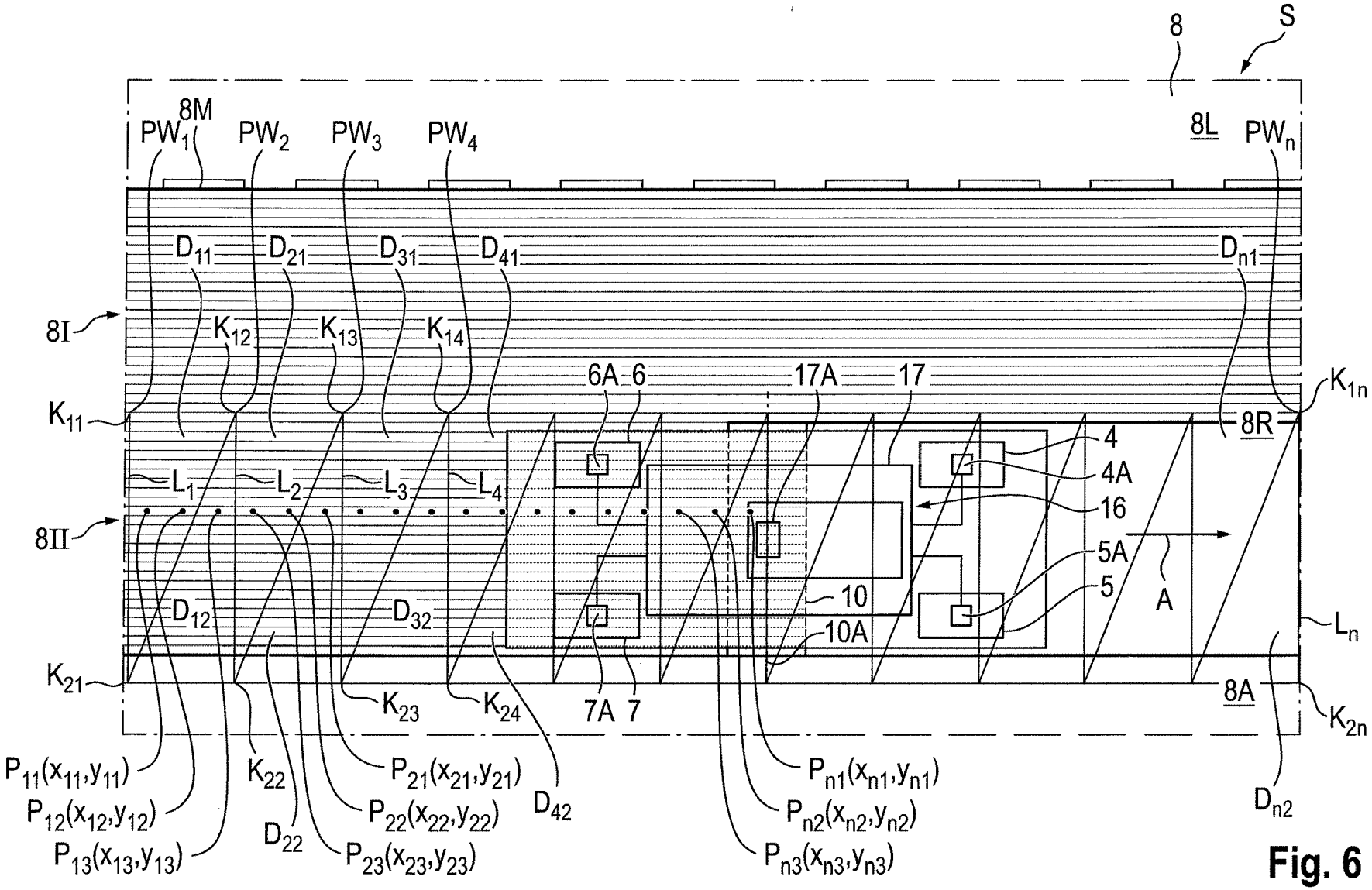
FIG. 6 shows a plan view of the road which is being processed by the ground-processing machine, wherein the ground-processing machine is processing a route portion on the outside of the lane.
Figure 7:
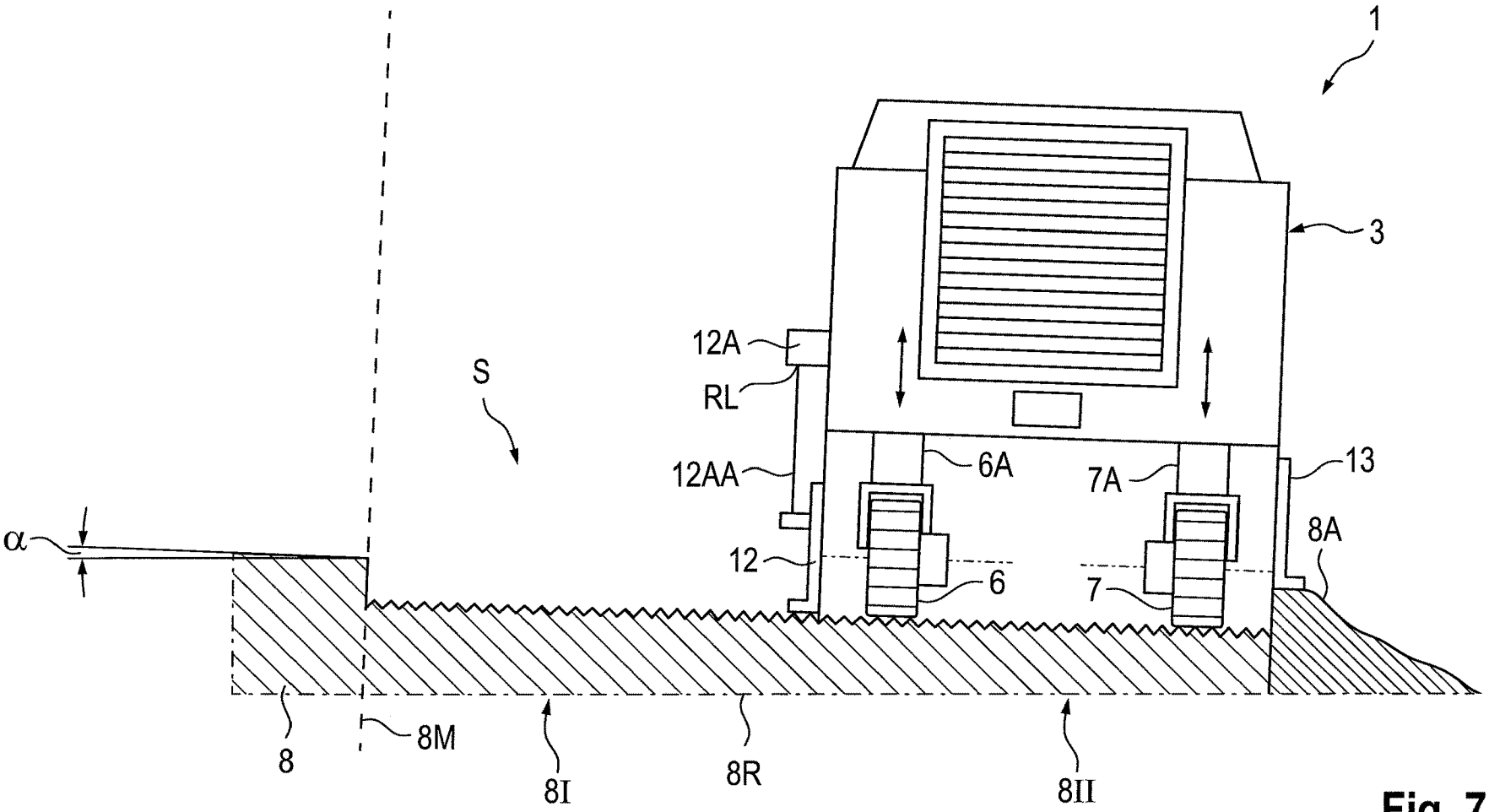
FIG. 7 shows a rear view of the ground-processing machine of FIG. 6.

FIGS. 3, 4 and 6, 7 show the road surface 8 of the left lane 8L and of the right lane 8R of the road S, the center line 8M, and the right edge strip 8A. In the present exemplary embodiment, the working width of the milling drum 10 corresponds approximately to half the width of the lanes 8L or 8R. Here, the working width of the milling drum (milling track) is somewhat greater than half the lane. The ground-processing machine 1 is to mill the left half 8I (left milling track) of the right lane 8R in a first work step I, and the right half 8II (the right milling track) of the right lane 8R in a second work step II. FIGS. 3 and 4 show a plan view of the road S and a rear view of the ground-processing machine 1 in the first work step I, and FIGS. 6 and 7 show a plan view of the road S and a rear view of the ground-processing machine 2 in the second work step II. In the present exemplary embodiment, the road S has a transverse inclination α to the right edge strip 8A, e.g., 1%, which can change in the course of the road. For better illustration, the transverse inclination α is exaggerated in FIGS. 4 and 7.

At the beginning of the milling work, the left and right distance measuring devices 14, 15 are calibrated; in particular, the zero point is set. The left and right distance measuring devices 14, 15 measure the distance of the reference point RL, RR from the surface 8 of the unprocessed ground. In order to set the zero point, in the case of an orientation of the ground-milling machine 1 parallel to the ground, the lifting devices 4A, 5A, 6A, 7A are set in such a way that the milling drum 10 just touches the ground surface 8 with the cylindrical lateral surface described by the tips of the milling tools. For this purpose, the lifting devices 4A, 5A, 6A, 7A are retracted until the milling tools of the rotating milling drum 10 start to scratch the ground, wherein the milling drum axis 10A is oriented parallel to the ground surface. This process is also referred to as scratching. When the milling tools touch the ground surface 8, the left and right distance measuring devices 14, 15 are set to zero. When the lifting devices 4A, 5A, 6A, 7A are retracted further and the milling drum 10 penetrates the substrate, negative distance values are determined. The amount of the distance values corresponds to the milling depth. In the present exemplary embodiment, a milling depth of 40 mm, for example, is set. For this purpose, for example, the front left running gear 4 is lowered by 40 mm and the front right running gear 5 is lowered by 40 mm, and the rear left running gear 6 is lowered by 40 mm together with the rear right running gear 7, which results in a milling depth of 40 mm.

In the present exemplary embodiment, the road surface to be processed with the milling drum 10 is to represent a copy of the unprocessed surface, i.e., in the longitudinal direction of the road S, a road surface with largely the same layer thickness is to be removed over the entire width of the milling drum, so that the transverse inclination α of the road S is not substantially changed. This process is also referred to as copy milling. However, it is also possible to change the transverse inclination of the road, wherein the surface of the milled road is not to run parallel to the unprocessed road surface.

During the advance of the ground-processing machine 1, the current milling depths on the right and left sides of the milling drum 10 are detected by the two measuring devices 14, 15. If one of the measuring devices 14, 15 detects a deviating milling depth, a corresponding correction takes place.

The control device 16 is configured in such a way that control signals are generated for the lifting devices 4A, 5A, 6A, 7A so that the lifting devices are retracted or extended as a function of the measurement signals of the draw-wire sensors 12A, 13A in such a way that, during the advance of the road-milling machine, the milling depths on the left and right sides of the milling drum 10 in the working direction are kept substantially constant, irrespective of the nature of the ground surface.

In the ground-processing machine according to the invention, the control device 16 has a transverse inclination model determination device 17 (FIG. 2), which is described below.

The transverse inclination model determination device 17 has a transverse inclination sensor 17A, which is designed in such a way that, during the advance of the ground-processing machine, a sequence of transverse inclination values describing the transverse inclination of the processed ground (road) in a direction transverse to the working direction A is determined. The transverse inclination sensor 17A measures the absolute transverse inclination α of the machine frame 3 and of the milling drum 10 or the milling drum axis 10A relative to the horizontal during the processing of the road. The transverse inclination sensor 17A can be arranged at any point on the machine frame 3. Since the machine frame is rigid, the same transverse inclination α is measured at each point of the machine frame.

Furthermore, the transverse inclination model determination device 17 has an evaluation device 17B, which is designed in such a way that a transverse inclination model describing the transverse inclination α is created from the sequence of the transverse inclination values. This transverse inclination model describes the transverse inclination α of a (future) milling track other than the milling track currently being processed by the ground-processing machine, which, in the present exemplary embodiment, is the right half 8II of the right lane 8R. The transverse inclination model is designed in such a way that the transverse inclination α detected in the left milling track that is currently being processed by the ground-processing machine is extrapolated to a lane portion to the right and/or to the left of this track. The portion covered by the transverse inclination model should have a width sufficient for this portion to at least the next (right) milling track, but it can also be selected to be wide enough that two or more laterally-adjacent milling tracks on the left and/or right sides are covered. In general, the transverse inclination in the lane portion to the right and/or to the left of the milling track that is currently being processed by the ground-processing machine corresponds to the transverse inclination of the milling track that is currently being processed, since the road S is to have the same transverse inclination $\alpha$ over the entire width. Moreover, the transverse inclination model determination device 17 comprises a memory device 17C which is configured in such a way that the transverse inclination model is stored.

The control device 16 is configured in such a way that a transverse inclination recording mode can be set in which, during the advance of the ground-processing machine 1, transverse inclination values are determined with the transverse inclination sensor 17A, and a transverse inclination model is created with the evaluation device 17B from the transverse inclination values, and the transverse inclination model is stored in the memory device 17C.

When the ground-processing machine processes the inner half 8I of the right lane 8R, the machine is operated in the transverse inclination recording mode in order to create a transverse inclination model for the processing of the outer half 8II of the right lane 8R. In the transverse inclination recording mode, the transverse inclination $\alpha$ of the road S is continuously or discontinuously detected with the transverse inclination sensor 17A during the advance of the ground-processing machine. The transverse inclination $\alpha$ can be measured at particular time intervals, in which particular distances are covered. These time intervals can be determined by a predetermined clock frequency. During the advance of the ground-processing machine, the transverse inclination can be measured at regular intervals, e.g., from 10 cm to 100 cm, wherein the travel speed can be kept constant. These distances can also be larger or smaller; for example, the distance can be changed statically or dynamically as a function of machine parameters—in particular, as a function of the milling width or the current steering angle. The transverse inclination $\alpha$ can also be detected at irregular intervals.

In the present exemplary embodiment, it is assumed that the transverse inclination $\alpha$ of the road S is detected discontinuously at constant intervals. During the advance of the ground-processing machine, the transverse inclination $\alpha$ of the processed ground surface is thus measured with the transverse inclination sensor 17A at successive waypoints $PW_1, PW_2, PW_3, \ldots, PW_n$ of the road S, which lie on a common axis. In the present exemplary embodiment, this axis intersects the longitudinal axis 10A of the milling drum 10 at a right angle and runs along the right outer edge of the milling drum or the milling track. It is assumed that the transverse inclination $\alpha$ changes in the longitudinal direction of the road S and does not change in the transverse direction of the road. With a continuous measurement of the transverse inclination at the particular intervals at the waypoints $PW_1, PW_2, PW_3, \ldots, PW_n$, there thus result transverse lines $L_1, L_2, L_3, \ldots, L_n$, on which the transverse inclination $\alpha$ is the same in each case.

The transverse inclination model determination device 17 has a position determination device 17D in order to determine position-related transverse inclination values from the transverse inclination values. The position determination device 17D can be a global navigation satellite system (GNSS), which determines the position of the waypoints $PW_1, PW_2, PW_3, \ldots, PW_n$ where the transverse inclination $\alpha$ is measured, in a coordinate system independent of the ground-processing machine 1. At the waypoints $PW_1, PW_2, PW_3, \ldots, PW_n$ or at the points in time at which the transverse inclination is measured, the position determination device 17D supplies position values (x, y) which are assigned to the measured transverse inclination values ($\alpha(x, y)$).

The evaluation device 17B of the transverse inclination model determination device 17 is configured in such a way that a transverse inclination model is created from the sequence of the position-related transverse inclination values ($\alpha(x, y)$), which transverse inclination model describes the transverse inclination $\alpha$ in a portion of the road S that lies to the right of the milling track of the ground-processing machine in the present exemplary embodiment. The transverse inclination model can describe a portion of the road S to the left and/or to the right of the milling track.

In the present exemplary embodiment, the evaluation device 17B creates, from the transverse inclinations a measured at the waypoints $PW_1, PW_2, PW_3, \ldots, PW_n$, a transverse inclination model describing the transverse inclination of the terrain surface in the adjacent portion(s) of the road S. The transverse inclination model can be a TIN model (triangulated irregular network (TIN)), whose supporting points (mass points) $K_1, K_2, K_3, \ldots, K_n$ are meshed by triangles $D_{11}, D_{12}, D_{21}, D_{22}, D_{31}, D_{32}, D_{41}, D_{42}, \ldots, D_{1n}, D_{2n}$, in order to create a network structure that describes the transverse inclination $\alpha$ at all points located within the network structure—for example, at the points $P_{11}, P_{12}, P_{13}, P_{21}, P_{22}, P_{23}, \ldots, P_{n1}, P_{n2}, P_{n3}$.

In the present exemplary embodiment, the waypoints $PW_1, PW_2, PW_3, \ldots, PW_n$ where the transverse inclination is measured form, as it were, the inner supporting points $K_{11}, K_{12}, K_{13}, K_{14}, \ldots, K_{1n}$ of the triangles $D_{11}, D_{12}, D_{21}, D_{22}, D_{31}, D_{32}, D_{41}, D_{42}, \ldots, D_{n1}, D_{n2}$ of the triangular structure. However, the transverse inclination $\alpha$ can also be measured at other points of the road S. At the outer supporting points $K_{21}, K_{22}, K_{23}, K_{24}, \ldots, K_{2n}$ in the present exemplary embodiment, the transverse inclination $\alpha$ is equal to the transverse inclination at the inner supporting points $K_{11}, K_{12}, K_{13}, K_{14}, \ldots, K_{1n}$. At any point within the triangles of the triangular structure, the transverse inclination $\alpha$ of the road S can now be determined by interpolation on the basis of the transverse inclination model with the known methods or algorithms for a portion of the road at least on one side of the ground-processing machine 1.

The transverse inclination model determined with the measured values in the inner half 8I is read into the memory device 17C for the processing of the outer half 8II. With regard to the transverse inclination $\alpha$, the information required for the processing of the outer half 8II is thus available.

FIGS. 6 and 7 show how the ground-processing machine 1 processes the outer milling track (half 8II). On this milling track (half 8II), the milling depth cannot be determined with the second, right measuring device 15, since the right edge protector 13 does not rest on the lane, but on the edge strip 8A, which does not form a suitable reference surface. Only the right edge protector 13, but not the right measuring device, is therefore shown in FIG. 7. For the milling depth on the left side, the control device 16 sets a value of zero, since the left edge protector 12, which is arranged on the left side between the left running gears 4, 6 next to the milling drum 10, rests on the already milled ground, i.e., is located 40 mm below the unprocessed ground surface 8.

For the processing of the outer half 8II, the control device 16 provides a transverse inclination control mode in which, during the advance of the ground-processing machine, the control of the lifting devices 4A, 5A, 6A, 7A takes place at least as a function of the transverse inclination values that are determined on the basis of the transverse inclination model stored in the memory device 17C. The control device 16 is configured in such a way that, during the advance of the ground-processing machine, with the position determination device 17D on the outer half 8II, the x/y-coordinates of the relevant points $P_{11}$, $P_{12}$, $P_{13}$, $P_{21}$, $P_{22}$, $P_{23}$, . . . , $P_{n1}$, $P_{n2}$, $P_{n3}$ where the milling drum 10 is located are continuously determined, and the target values αsoll for the transverse inclination to be set at these points are determined for these points with the transverse inclination model. These points $P_{11}$, $P_{12}$, $P_{13}$, $P_{21}$, $P_{22}$, $P_{23}$, . . . , $P_{n1}$, $P_{n2}$, $P_{n3}$ can be points in the milling track of the ground-processing machine which relate to a reference point of the ground-processing machine, e.g., a reference point on the milling drum axis 10A of the milling drum 10—in particular, the center perpendicular of the milling drum 10. The coordinates (x, y) of the position points, e.g., $P_{11}(x_{11}, y_{11})$, are determined by the position determination device (17D). During the advance of the ground-processing machine 1, the target values αsoll of the transverse inclination α at the individual position points on the outer half 8II are thus continuously determined with the transverse inclination model (α(x, y)). The computing operations required for this purpose take place with the evaluation device 17B.

The control device 16 is configured in such a way that the front right lifting device 7A is actuated in such a way that the actual value of the transverse inclination corresponds to the target value. This ensures that the right milling track adjoins the left milling track with the same transverse inclination. Since the transverse inclination of the machine frame 3 or of the milling drum 10 is controlled, the milling depth on the right side of the machine frame 3 does not need to be measured, which would also not be possible due to the edge strip 8A. In the case of a ground-processing machine with a front pendulum axle, in an analogous approach, the rear right lifting device is actuated. A ground-processing machine for left-hand traffic provides, in an analogous approach, an actuation of the left, front or rear, lifting device instead of the right, front or rear, lifting device.

The working process described above can be performed with only one ground-processing machine, wherein the determined transverse inclination model is read into the memory device 17C and read out of the memory device. An alternative embodiment of a ground-processing machine, which is designed in combination with several ground-processing machines for the simultaneous processing of a traffic area, is described below with reference to FIG. 8. Corresponding components are provided with the same reference signs. The traffic area can, for example, be a landing runway for aircraft, which is to be processed with several ground-processing machines in order to shorten the processing time.

Figure 8:
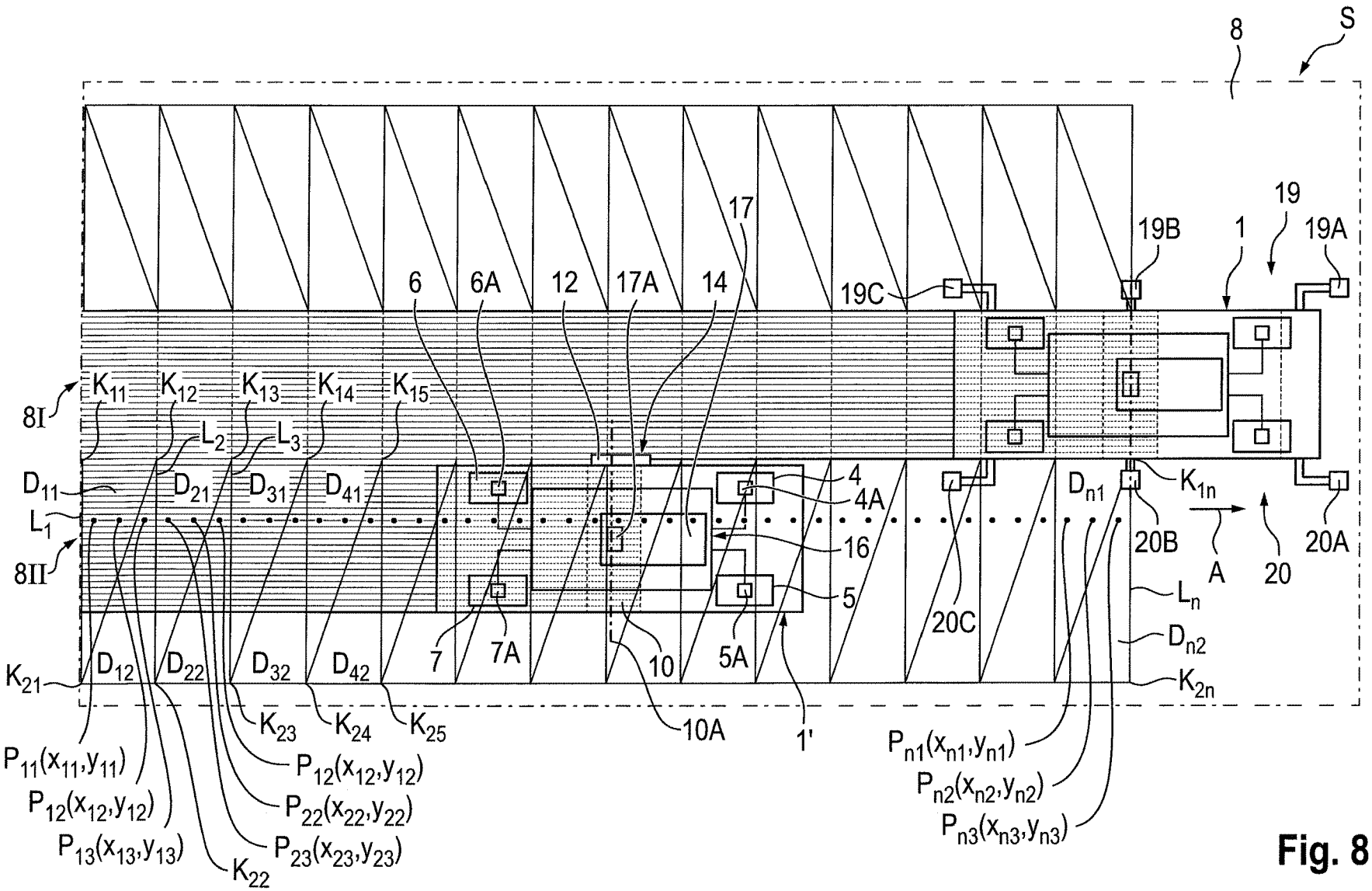
FIG. 8 shows a plan view of a traffic area which is simultaneously processed by two ground-processing machines of a machine combination.

FIG. 8 shows two ground-processing machines 1, 1' which work in combination. The individual parts are provided with the same reference signs in FIG. 8. Below, the left ground-processing machine 1 in the working direction A is referred to as the first and the right ground-processing machine 1' is referred to as the second machine. The first machine 1 runs ahead of the second-machine 1' in the working direction A. However, it is also possible for more than two machines to be used, wherein the machines move at a lateral and longitudinal offset from one another.

In the present exemplary embodiment, an edge strip, which could exclude the use of the left and right measuring devices 14, 15 for controlling the milling depth, is not present, but the use of the right milling depth control is to be dispensed with, since the landing runway is damaged on the right side of the second ground-processing machine, so that the surface thereof on the right side cannot serve as a reference surface. Consequently, the transverse inclination control described with reference to FIGS. 3, 4 and 6, 7 is to be provided for the second-machine 1'.

The first ground-processing machine 1 of FIG. 8 differs from the ground-processing machine described with reference to FIGS. 3, 4 and 6, 7 by a transverse inclination model transmission device 18 shown in FIG. 2, which has a data transmission device 18A, wherein the data transmission device 18A is designed in such a way that the transverse inclination model is sent to a data receiving device 18B of another ground-processing machine traveling in another milling track. The second ground-processing machine 1' of FIG. 8 differs from the ground-processing machine of FIGS. 3, 4 and 6, 7 by a transverse inclination model transmission device 18, which has a data receiving device 18B, which is designed in such a way that the transverse inclination model of another ground-processing machine 1 traveling in another milling track is received. However, it is also possible for both ground-processing machines 1, 1' to have both a data transmission device and a data receiving device. The ground-processing machine described with reference to FIGS. 3, 4 and 6, 7 can also have a data transmission device and/or data receiving device, which is shown in FIG. 2, so that this ground-processing machine can be used universally. The data transmission device and data receiving device can be a transmitting and receiving device, which can comprise a radio transmitter and radio receiver that communicate directly with one another. However, the data transmission device can also send the relevant data to a cloud, and the data receiving device can receive data from a cloud. The data transmission device and data receiving device can also communicate with one another via a WLAN (wireless local area network).

During the advance of the two ground-processing machines 1, 1', the first machine 1 sends the transverse inclination model, which was previously determined in the preceding route portion and describes the transverse inclination α in the route portion relating to the second ground-processing machine 1', to the second ground-processing machine 1'. During the advance of the two ground-processing machines 1, 1', the transverse inclination model determined by the first ground-processing machine 1 is sent with the data transmission device 18A and received by the data receiving device 18B of the second ground-processing machine 1', wherein the second ground-processing machine 1' performs the transverse inclination control on the basis of the previously determined transverse inclination model, as described with reference to FIGS. 3, 4 and 6, 7. The first ground-processing machine 1 can also send the transverse inclination model to further ground-processing machines (not shown in FIG. 8) so that the processing of the landing runway can take place simultaneously with more than two ground-processing machines.

In the exemplary embodiment of FIG. 8, the left and right distance measuring devices of the first ground-processing machine 1 in the working direction A are not part of the left or right edge protector, but, for distance measurement, a measuring system known as a multiplex leveling system 19, 20 is provided on both sides and has, on the left or right side of the machine, several distance sensors 19A, 19B, 19C or 20A, 20B, 20C arranged at a distance from one another in the longitudinal direction of the processed ground below in order to be able to calculate a mean value from the measured values of the individual sensors. The multiplex leveling system can comprise a front distance sensor 19A, 20A, a center distance sensor 19B, 20B, and a rear distance sensor 19C, 20C. The distance sensors can be fastened to arms attached to one side of the machine frame 3.

The second ground-processing machine 1' has only a left distance measuring device 14 in the working direction, since a right distance measuring device is obsolete due to the transverse inclination control according to the invention on the basis of the transverse inclination model. The left distance measuring device 14 can make use of the left edge protector 12, as described with reference to FIGS. 3, 4 and 6, 7.

When the traffic area is processed with more than two ground-processing machines, the TIN model must cover a sufficiently wide portion of the traffic area. With a first ground-processing machine, in a preceding working process, the information required for performing a working process following the preceding working process with one or more ground-processing machines with respect to the transverse inclination $\alpha$ to be set can, for example, provide.

Figure 9:
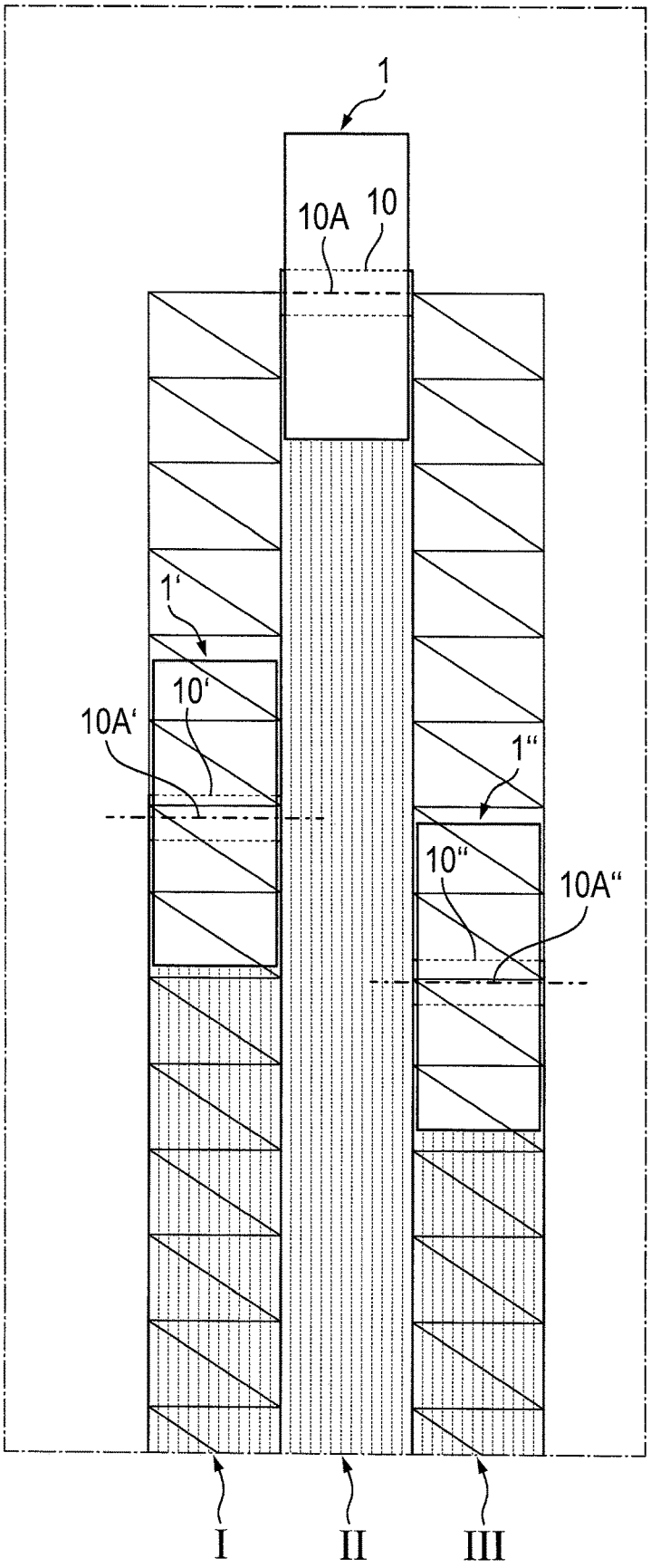
FIG. 9 shows a plan view of a traffic area in a further exemplary embodiment, in which the traffic area is simultaneously processed by several ground-processing machines of a machine combination.

FIG. 9 shows an exemplary embodiment in which a traffic area is simultaneously processed with several ground-processing machines 1, 1', 1". The first ground-processing machine 1' traveling ahead in a center milling track II is operated in the transverse inclination recording mode, wherein the transverse inclination model in each case covers a portion of the traffic area on the left and right sides of the center milling track II in the working direction. The first ground-processing machine 1 is the pilot machine. The first ground-processing machine 1 is followed by a second ground-processing machine 1' (milling track I) on the left side in the working direction and by a third ground-processing machine 1" (milling track Ill) on the right side. The second and third ground-processing machines 1', 1" are daughter machines, which are operated in the transverse inclination control mode on the basis of the transverse inclination model determined with the first ground-processing machine 1.

Figure 10:
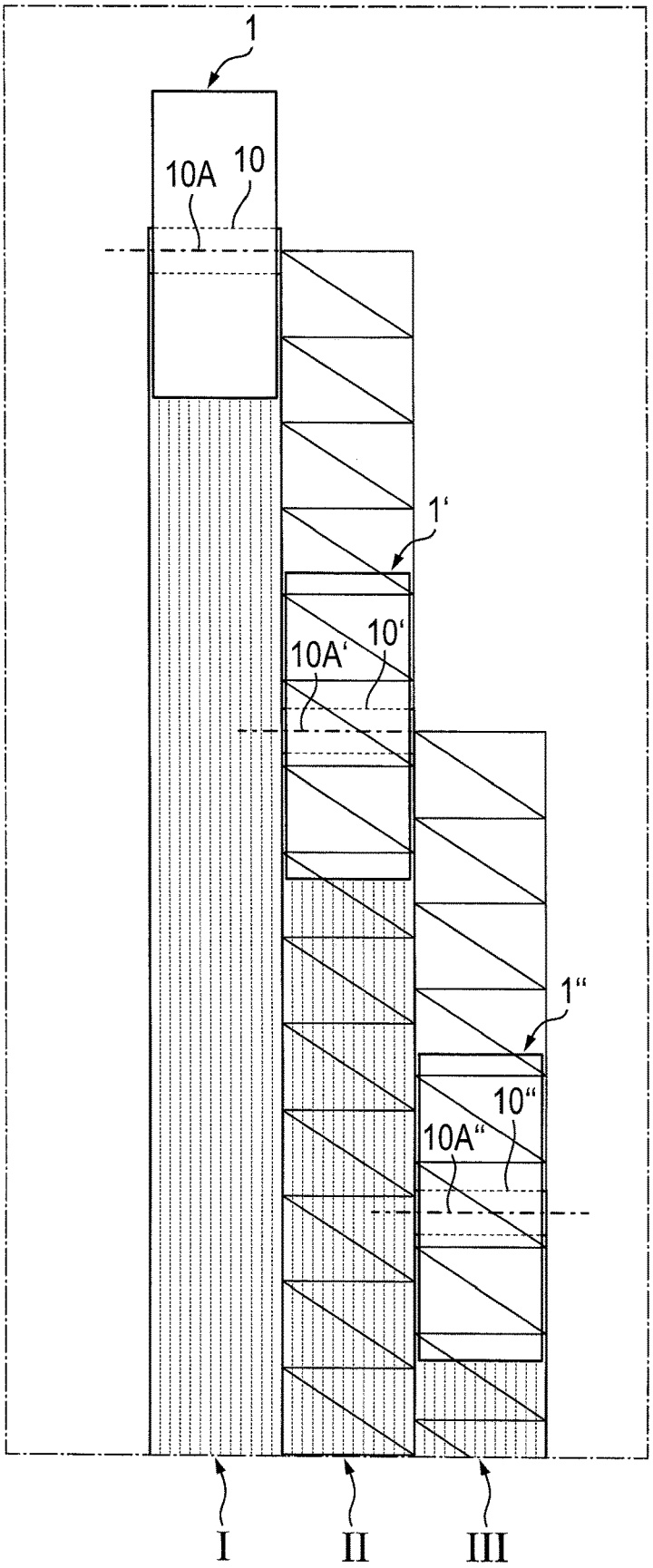
FIG. 10 shows a plan view of a traffic area in a further exemplary embodiment with several ground-processing machines.

FIG. 10 shows a further exemplary embodiment in which the first ground-processing machine 1 traveling ahead in an outer milling track I is operated in the transverse inclination recording mode, wherein the transverse inclination model covers a portion of the traffic area on the right side of the outer milling track I in the working direction. The first ground-processing machine 1 is the pilot machine. The first ground-processing machine is followed by a second ground-processing machine 1' in a second milling track II on the right side in the working direction, wherein the second ground-processing machine 1' is followed by a third ground-processing machine 1" in a third milling track Ill on the right side in the working direction. The second ground-processing machine 1' is operated in the transverse inclination control mode on the basis of the transverse inclination model determined with the first ground-processing machine 1 for the second milling track II. Consequently, the second ground-processing machine 1' is a daughter machine of the first machine 1. The second ground-processing machine 1' can simultaneously be a pilot machine for the third ground-processing machine 1" if the second machine 1' is simultaneously operated in the transverse inclination recording mode, and the third-machine 1" is operated in the transverse inclination control mode. The second machine 1' then provides, for the third machine 1", a transverse inclination model covering the third milling track Ill.

Figure 11:
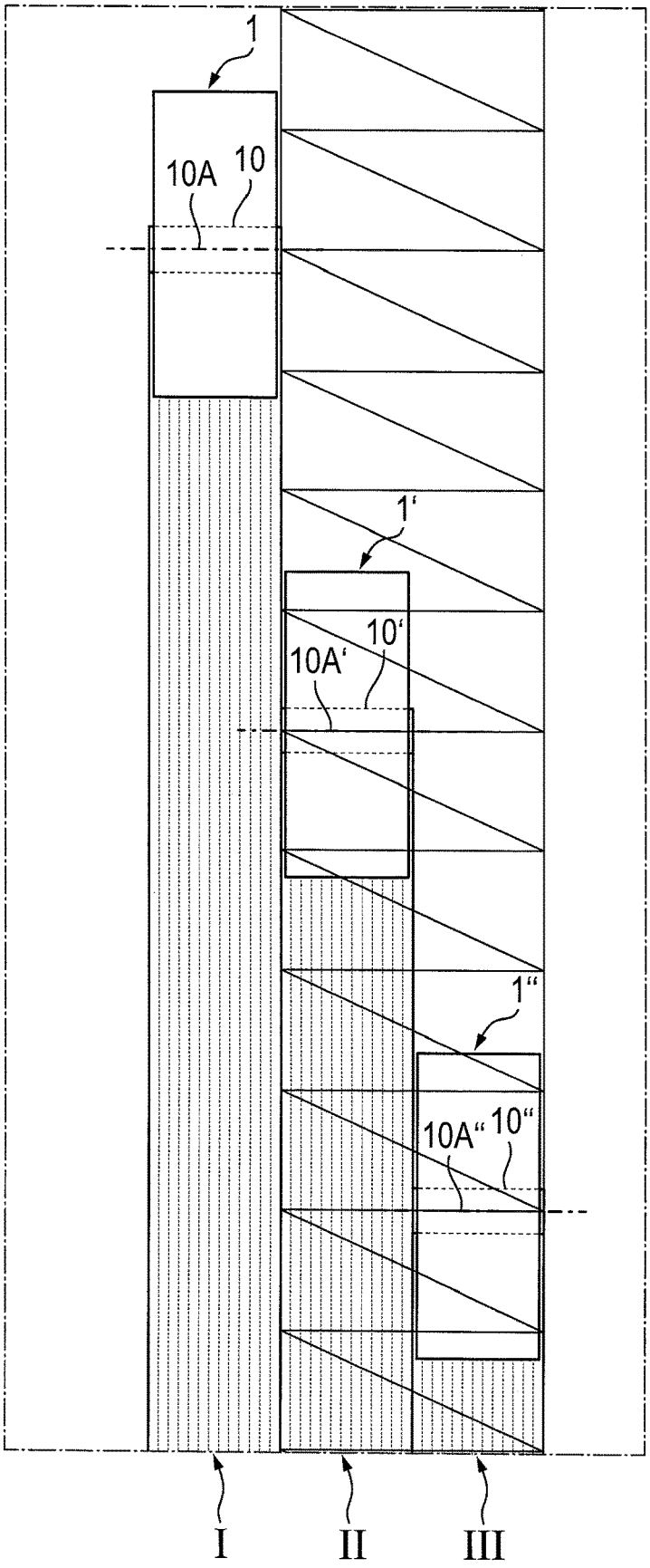
FIG. 11 shows a plan view of a traffic area in a further exemplary embodiment with several ground-processing machines.

FIG. 11 shows a further exemplary embodiment in which a traffic area is simultaneously processed with several ground-processing machines. The first ground-processing machine 1 traveling ahead in an outer milling track I is operated in the transverse inclination recording mode, wherein the transverse inclination model covers a portion of the traffic area on the right side of the outer milling track I in the working direction. The first ground-processing machine 1' is the pilot machine. The first ground-processing machine 1 is followed by a second ground-processing machine 1' in a second milling track II on the right side in the working direction, wherein the second ground-processing machine is followed by a third ground-processing machine 1" in a third milling track Ill on the right side in the working direction. The second and third ground-processing machines 1', 1" are daughter machines, which are operated in the transverse inclination control mode on the basis of the transverse inclination model determined with the first ground-processing machine 1.

Figure 12:
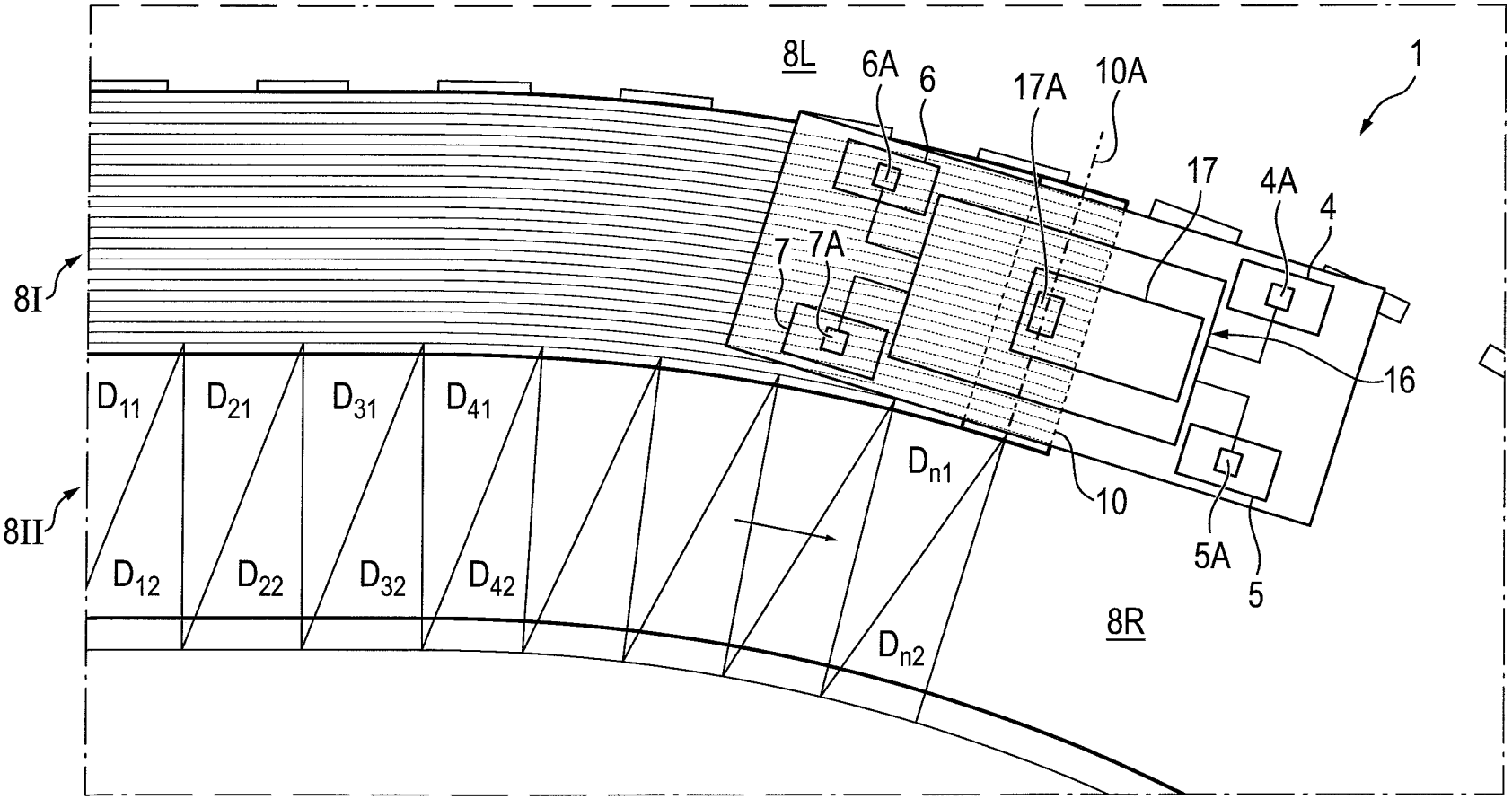
FIG. 12 shows a plan view of a road which is processed by a ground-processing machine, wherein the road has a straight portion which transitions into a curve.

FIG. 12 shows a plan view of a road which has a straight portion, which transitions into a curve, wherein the road is processed by a ground-processing machine 1. FIG. 12 shows the right lane of the road, on which the ground-processing machine 1 moves. The ground-processing machine 1 is one of the machines described with reference to the preceding figures. The individual parts are provided in FIG. 12 with the same reference signs as in the preceding figures. The ground-processing machine 1 processes the left half 8I of the right lane (left milling track) in the working direction. While the ground-processing machine 1 moves in the working direction, the TIN model for the right half 8II of the right lane (right milling track) is determined. FIG. 12 shows how the triangles $D_1, D_{12}, D_{21}, D_{22}, D_{31}, D_{32}, D_{41}, D_{42}, \ldots, D_{1n}, D_{2n}$ of the TIN model change at the transition from the straight portion to the curve. It is found that the shape of the triangles is determined by the radius of the curve. In the region of the curve, the transverse legs of adjacent triangles no longer run parallel to one another, since their extensions intersect at a point that is located outside the dot-dashed line. As a function of the transverse inclination values determined on the basis of the TIN model, another ground-processing machine can then process the right half 8II of the right lane (right milling track).

What is claimed is:

1. A self-propelled road milling machine comprising:

a machine frame supported by running gears and having a milling drum arranged thereon;

lifting devices assigned to the running gears;

a transverse inclination sensor configured, during an advance of the road milling machine along a current milling track of a road, to determine a sequence of transverse inclination values describing a transverse inclination of the processed ground in a direction transverse to the working direction;

a data transmission device;

a data receiving device;

a position determination device configured to determine x-coordinates and y-coordinates which describe respective positions of position points during the advance of the road milling machine along the current milling track; and a control device configured to generate control signals for the lifting devices, wherein the lifting devices are configured to be retracted or extended as a function of the control signals for lowering or raising the machine frame relative to the ground;

wherein the control device further is configured, in accordance with a transverse inclination recording mode and during the advance of the road milling machine, to determine position-related transverse inclination values comprising the x-coordinates and y-coordinates at the respective position points along the current milling track, and further comprising the respective transverse inclinations at these position points, to create a transverse inclination model describing the transverse inclination extrapolated to laterally corresponding position points in one or more subsequent milling tracks of the road adjacent to the current milling track, based on the determined position-related transverse inclination values, and to send the transverse inclination model to a data receiving device of another road milling machine or to a cloud;

wherein the control device further is configured, in accordance with a transverse inclination control mode for at least one of the one or more subsequent milling tracks, to control at least one of the lifting devices at least as a function of the transverse inclination values that are determined based on the transverse inclination model read out from the data receiving device of the other road milling machine or the cloud, wherein transverse inclination values are interpolated for a respective portion of the road between each set of the laterally corresponding position points.

2. The self-propelled road milling machine of claim 1, comprising:

a first measuring device configured to measure a distance of a first reference point on the road milling machine from a surface of non-processed ground on a first side of the milling drum in a working direction; and a second measuring device configured to measure a distance of a second reference point on the road milling machine from the surface of the non-processed ground on a second side of the milling drum in the working direction.

3. The self-propelled road milling machine of claim 2, wherein:

the control device is configured in the transverse inclination recording mode to actuate the lifting devices such that, during the advance of the road milling machine, a milling depth detected by the first measuring device on the first side of the road milling machine and a milling depth detected by the second measuring device on the second side of the road milling machine are kept substantially constant.

4. The self-propelled road milling machine of claim 3, comprising:

a first front running gear on the first side of the road milling machine, to which is assigned a first front lifting device on the first side of the road milling machine;

a second front running gear on the second side of the road milling machine, to which is assigned a second front lifting device on the second side of the road milling machine;

a first rear running gear on the first side of the road milling machine, to which is assigned a first rear lifting device on the first side of the road milling machine;

a second rear running gear on the second side of the road milling, to which is assigned a second rear lifting device on the second side of the road milling;

wherein the control device is configured, in the transverse inclination control mode, to actuate at least the front or rear lifting device on the first side of the road milling machine such that, during the advance of the road milling machine, the milling depth detected by the first measuring device is kept substantially constant, and to actuate at least the front or rear lifting device on the second side of the road milling machine, at least as a function of the transverse inclination values that are determined based on the transverse inclination model, such that, during the advance of the road milling machine, the machine frame assumes a transverse inclination that corresponds to transverse inclination predetermined by the transverse inclination model.

5. The self-propelled road milling machine of claim 2, wherein one or more of the first measuring device and the second measuring device has at least one distance sensor which is a contact distance sensor or a non-contact distance sensor.

6. A system for simultaneously processing a ground with at least first and second self-propelled road milling machines, the system comprising:

for each of the first and second road milling machines:

a machine frame supported by running gears;

a milling drum arranged on the machine frame;

lifting devices assigned to the running gears for raising and lowering the running gears relative to the machine frame and responsive to actuation via a control device, wherein a first track and an adjacent second track are simultaneously processed with the first road milling machine and with the second road milling machine, respectively;

the control device for the first road milling machine configured, during the processing of the first track in a transverse inclination recording mode, to:

determine a sequence of position-related transverse inclination values comprising x-coordinates and y-coordinates and describing the transverse inclination of the processed ground in a direction transverse to the working direction at each of respective position points;

create a transverse inclination model describing the transverse inclination extrapolated to laterally corresponding position points in at least the second track of the road based on the determined position-related transverse inclination values; and transmit the transverse inclination model to the second road milling machine; and the control device for the second road milling machine configured, during the processing of the second track in a transverse inclination control mode, to control at least one of the lifting devices at least as a function of the transverse inclination values that are determined based on the transverse inclination model received from the first road milling machine, wherein transverse inclination values are interpolated for a respective portion of the road between each set of the laterally corresponding position points.

7. The system of claim 6, wherein at least the first road milling machine comprises:

a first measuring device configured to measure a distance of a first reference point on the first road milling machine from a surface of non-processed ground on a first side of the milling drum in a working direction; and a second measuring device configured to measure a distance of a second reference point on the first road milling machine from the surface of the non-processed ground on a second side of the milling drum in the working direction.

8. The system of claim 7, wherein:

the control device of at least the first road milling machine is configured in the transverse inclination recording mode to actuate the lifting devices such that, during the advance of the first road milling machine, a milling depth detected by the first measuring device on the first side of the first road milling machine and a milling depth detected by the second measuring device on the second side of the first road milling machine are kept substantially constant.

9. The system of claim 8, each of the first and second road milling machines comprising:

a first front running gear on the first side of the road milling machine, to which is assigned a first front lifting device on the first side of the road milling machine;

a second front running gear on the second side of the road milling machine, to which is assigned a second front lifting device on the second side of the road milling machine;

a first rear running gear on the first side of the road milling machine, to which is assigned a first rear lifting device on the first side of the road milling machine;

a second rear running gear on the second side of the road milling, to which is assigned a second rear lifting device on the second side of the road milling machine;

wherein the control device is configured, in the transverse inclination control mode, to actuate at least the front or rear lifting device on the first side of the road milling machine such that, during the advance of the road milling machine, the milling depth detected by the first measuring device is kept substantially constant, and to actuate at least the front or rear lifting device on the second side of the road milling machine, at least as a function of the transverse inclination values that are determined based on the transverse inclination model, such that, during the advance of the road milling machine, the machine frame assumes a transverse inclination that corresponds to transverse inclination predetermined by the transverse inclination model.

10. The system of claim 7, wherein one or more of the first measuring device and the second measuring device has at least one distance sensor which is a contact distance sensor or a non-contact distance sensor.

11. The system of claim 6, wherein at least the first road milling machine comprises a position determination device configured to determine position-related transverse inclination values from the transverse inclination values, wherein the respective control device is configured to create the transverse inclination model further based on the determined position-related transverse inclination values.

12. The system of claim 11, wherein the position-related transverse inclination values comprise x-coordinates and y-coordinates, which describe the position of respective position points and are determined with the position determination device, and wherein the position-related transverse inclination values comprise the transverse inclinations determined with the transverse inclination sensor at these position points.

13. A method for simultaneously processing a ground with at least first and second self-propelled road milling machines, each of the first and second road milling machines having a machine frame supported by running gears, a milling drum arranged on the machine frame, and lifting devices assigned to the running gears for raising and lowering the running gears relative to the machine frame and responsive to actuation via a control device, wherein a first track and an adjacent second track are simultaneously processed with the first road milling machine and with the second road milling machine, respectively, the method comprising:

during the processing of the first track in a transverse inclination recording mode, during the advance of the first road milling machine, determining a sequence of transverse inclination values describing the transverse inclination of the processed ground in a direction transverse to the working direction, creating a transverse inclination model describing the transverse inclination extrapolated to laterally corresponding position points in at least the second track of the road based on the determined position-related transverse inclination values, and transmitting the transverse inclination model to the second road milling machine; and during the processing of the second track in a transverse inclination control mode, controlling at least one of the lifting devices at least as a function of the transverse inclination values that are determined based on the transverse inclination model received from the first road milling machine, wherein transverse inclination values are interpolated for a respective portion of the road between each set of the laterally corresponding position points.

14. The method of claim 13, comprising:

measuring a distance between a first reference point on the first road milling machine and a surface of non-processed ground on a first side of the milling drum in a working direction; and measuring a distance between a second reference point on the first road milling machine and the surface of the non-processed ground on a second side of the milling drum in the working direction.

15. The method of claim 14, comprising:

in the transverse inclination recording mode, actuating the lifting devices of the first road milling machine such that a milling depth detected on the first side of the first road milling machine and a milling depth detected on the second side of the first road milling machine are kept substantially constant.

16. The method of claim 15, comprising:

actuating at least a front lifting device or a rear lifting device on the first side of a respective road milling machine such that the milling depth detected on the first side of the respective road milling machine is kept substantially constant; and actuating at least a front lifting device or a rear lifting device on the second side of the respective road milling machine, at least as a function of the transverse inclination values that are determined based on the transverse inclination model, such that, during the advance of the respective road milling machine, the machine frame assumes a transverse inclination that corresponds to transverse inclination predetermined by the transverse inclination model.

17. The method of claim 13, comprising determining position-related transverse inclination values from the transverse inclination values, wherein the transverse inclination model is created based at least in part on the determined position-related transverse inclination values.

18. The system of claim 17, wherein the position-related transverse inclination values comprise x-coordinates and y-coordinates, describing the position of respective position points, and the transverse inclinations determined at these position points.

* * * * *